US007762490B1

(12) United States Patent
Yu Chen

(10) Patent No.: US 7,762,490 B1
(45) Date of Patent: Jul. 27, 2010

(54) MULTI-SECTION ASSEMBLED FILM PACKING APPLICATOR

(76) Inventor: Hsiu-Man Yu Chen, No. 40, Sec. 1, Ta Fu Rd., Tan Tzu Township, Taichung County (TW)

( * ) Notice: Subject to any disclaimer, the term of this patent is extended or adjusted under 35 U.S.C. 154(b) by 0 days.

(21) Appl. No.: 12/428,588

(22) Filed: Apr. 23, 2009

(51) Int. Cl.
*B65H 75/38* (2006.01)

(52) U.S. Cl. ..... 242/405.2; 242/405.3; 242/422.4; 242/588.2

(58) Field of Classification Search ..... 242/422.4, 242/118.4, 118.41, 129.51, 596, 596.2, 588.2, 242/590, 405.2–405.3, 594.2–594.6; 53/591–592
See application file for complete search history.

(56) References Cited

U.S. PATENT DOCUMENTS 4,179,081 A * 12/1979 Parry ..... 242/422.1
4,530,473 A * 7/1985 Parry ..... 242/588.2
5,351,905 A * 10/1994 Ferber ..... 242/588.2
6,102,323 A * 8/2000 Riemenschneider ..... 242/422.4
7,380,744 B1 * 6/2008 Yu Chen ..... 242/422.4
2006/0032965 A1 * 2/2006 Yu Chen ..... 242/422.4
2006/0278751 A1 * 12/2006 Chen ..... 242/588.2

* cited by examiner

*Primary Examiner*—Sang Kim
(74) *Attorney, Agent, or Firm*—Ming Chow; Sinorica, LLC

(57) ABSTRACT

A multi-section assembled film packing applicator includes two handles and a plurality of axle tubes. Each handle includes a handle sleeve and an engaging unit at one end of the handle sleeve. The plurality of axle tubes is connected in series between the two handles. Each of the axle tubes has two axial opposite ends each provided with a connecting unit. The connecting unit engages with the engaging unit. The axle tubes are connected with their respective connecting units. The number of the axle tubes is adjustable depending on the width of a film for a user to operate the film packing applicator smoothly. The present invention also provides a fast and convenient way to assemble and disassemble.

5 Claims, 6 Drawing Sheets

MULTI-SECTION ASSEMBLED FILM PACKING APPLICATOR

BACKGROUND OF THE INVENTION

1. Field of the Invention

The present invention relates to a multi-section assembled film packing applicator.

2. Description of the Prior Art

Referring to FIG. 1, a conventional film packing applicator comprises a base body 1 and a rod 2. The rod 2 is screwed to the base body 1. The rod 2 is moved axially with respect to the base body 1 for coupling with various films in different sizes. When the film runs out, it is necessary to dismount the rod 2 from the base body 1. This wastes time, and it is not easy and convenient to assemble or disassemble the conventional film packing applicator. If the width of the film is too small, the rod 2 is unable to match up well. Thus, the operation is not smooth. In addition, the rod 2 doesn't provide an outward push force. It is required to add a film reel to prop the film, which increases the cost of manufacture and the amount of trash. Therefore, the conventional film packing applicator needs to be improved.

SUMMARY OF THE INVENTION

A multi-section assembled film packing applicator includes two handles and a plurality of axle tubes. Each handle includes a handle sleeve and an engaging unit at one end of the handle sleeve. The plurality of axle tubes is connected in series between the two handles. Each of the axle tubes has two axial opposite ends each provided with a connecting unit. The connecting unit engages with the engaging unit. The axle tubes are connected with their respective connecting units. The number of the axle tubes is adjustable depending on the width of a film for a user to operate the film packing applicator smoothly. The present invention also provides a fast and convenient way to assemble and disassemble.

DETAILED DESCRIPTION OF THE PREFERRED EMBODIMENT

Embodiments of the present invention will now be described, by way of example only, with reference to the accompanying drawings.

Figure 1:
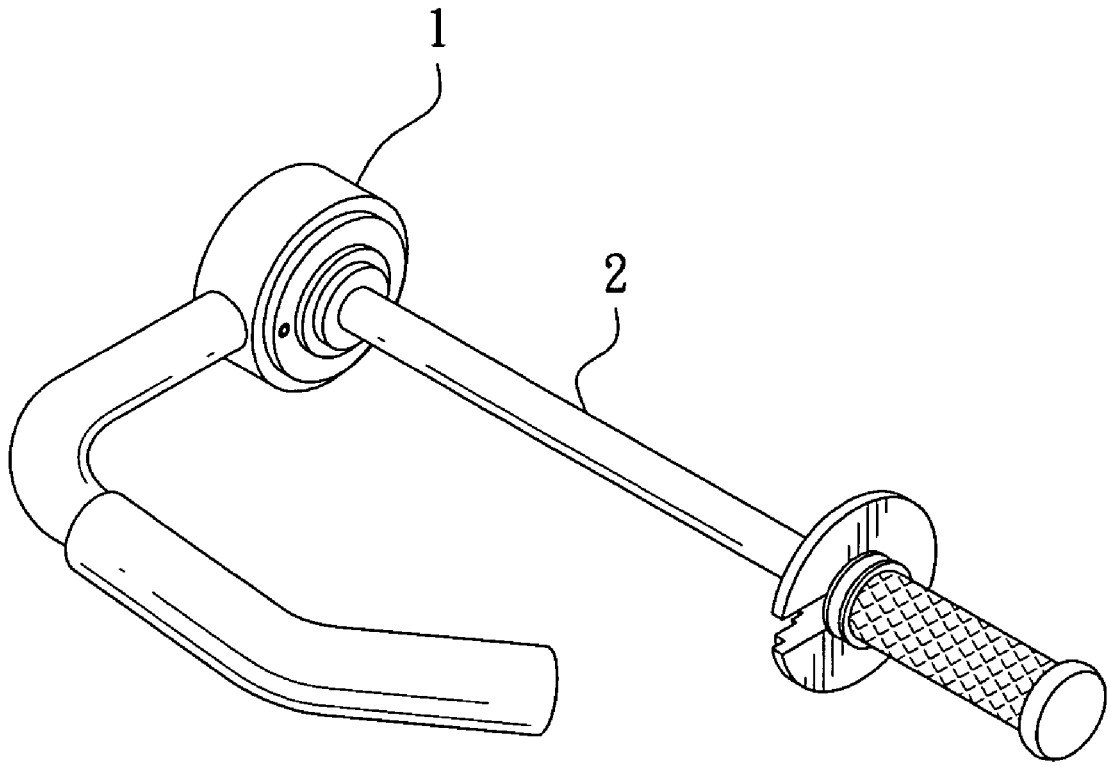
FIG. 1 PRIOR ART
FIG. 1 is a perspective view of a conventional film packing applicator.
Figure 2:
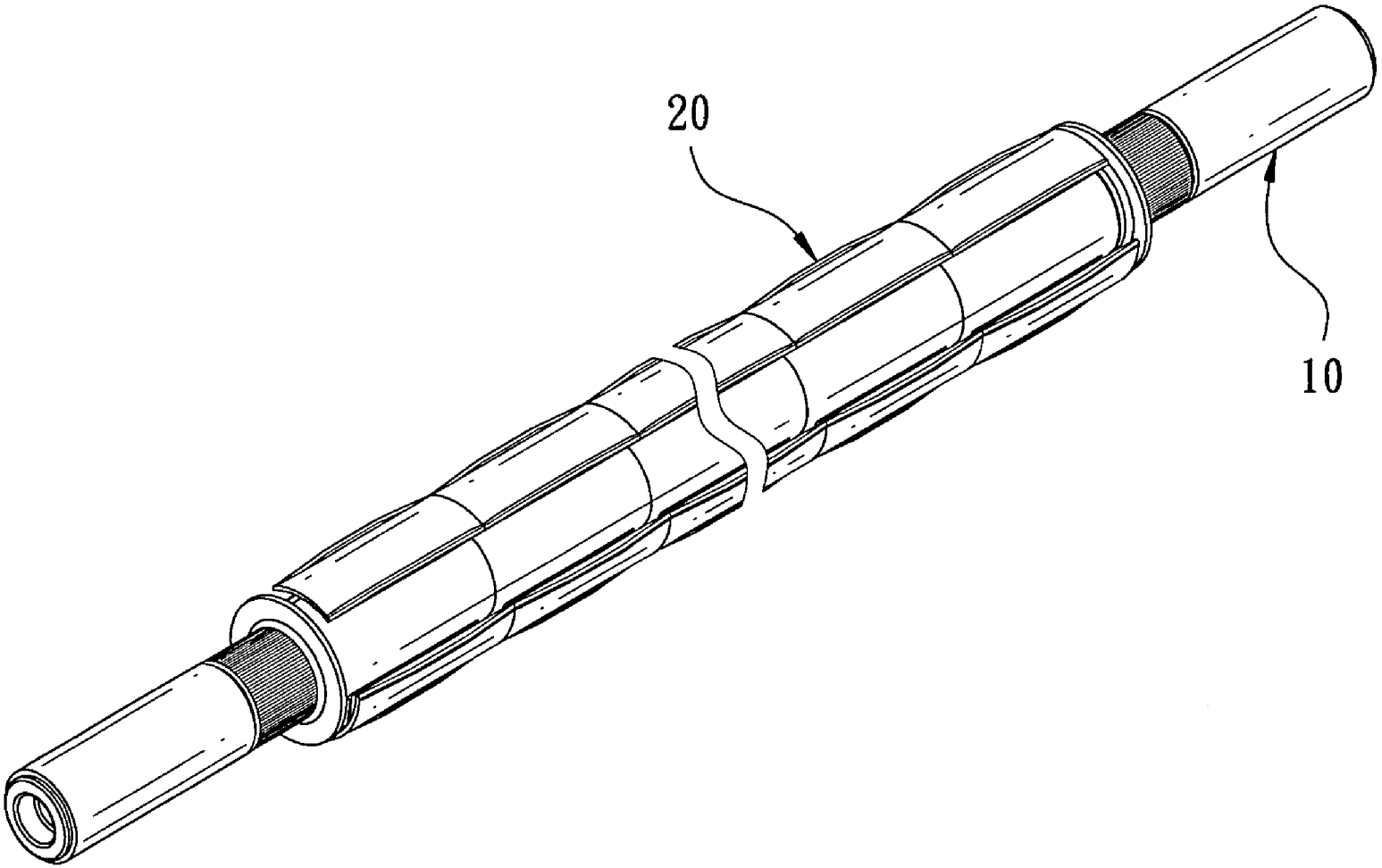
FIG. 2 is a perspective view of a film packing applicator of the present invention.
Figure 3:
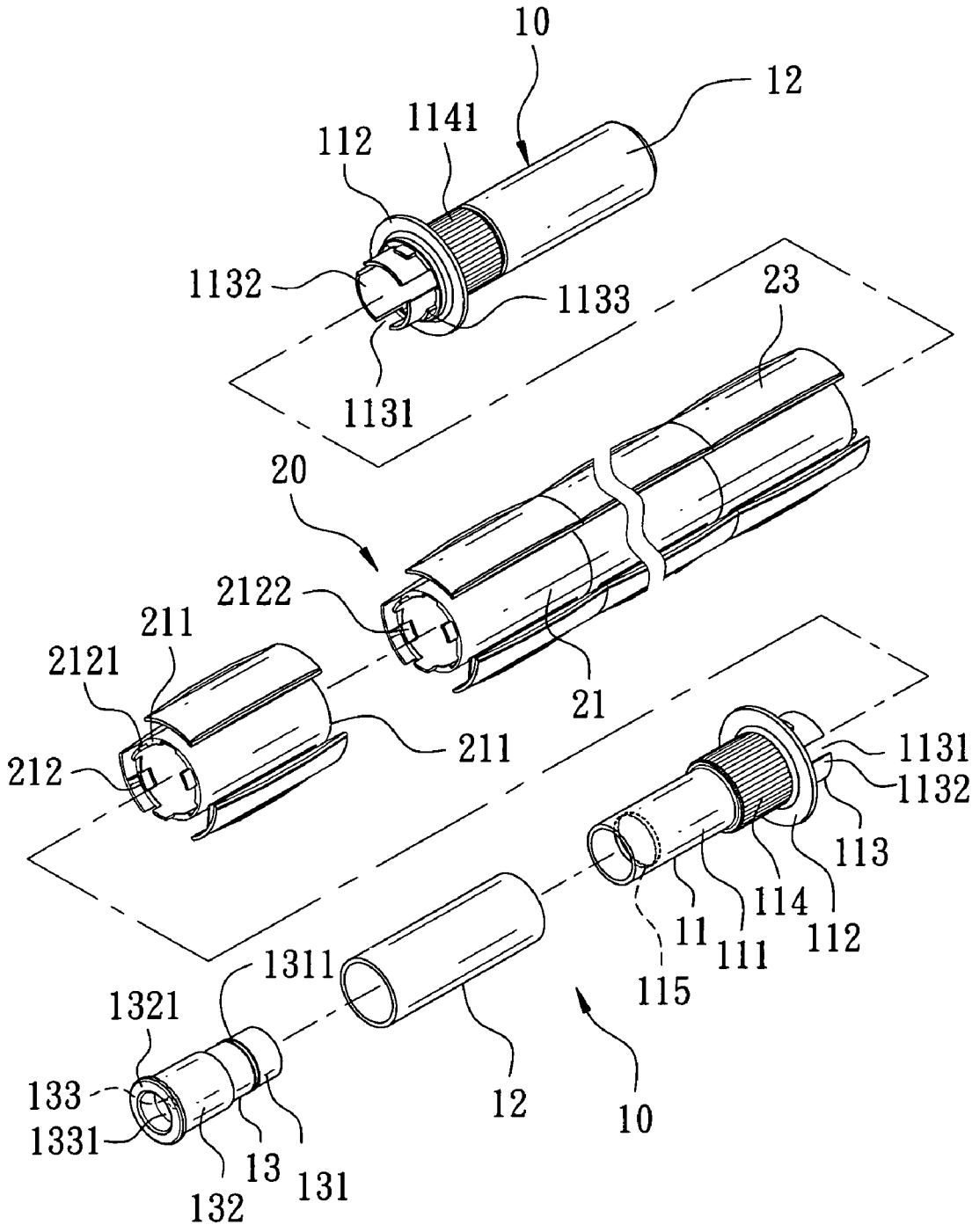
FIG. 3 is an exploded view of the film packing applicator of the present invention.

FIG. 2 is a perspective view of a film packing applicator of the present invention. FIG. 3 is an exploded view of the film packing applicator of the present invention. The film packing applicator of the present invention comprises two handles 10 and a plurality of axle tubes 20.

Figure 5:
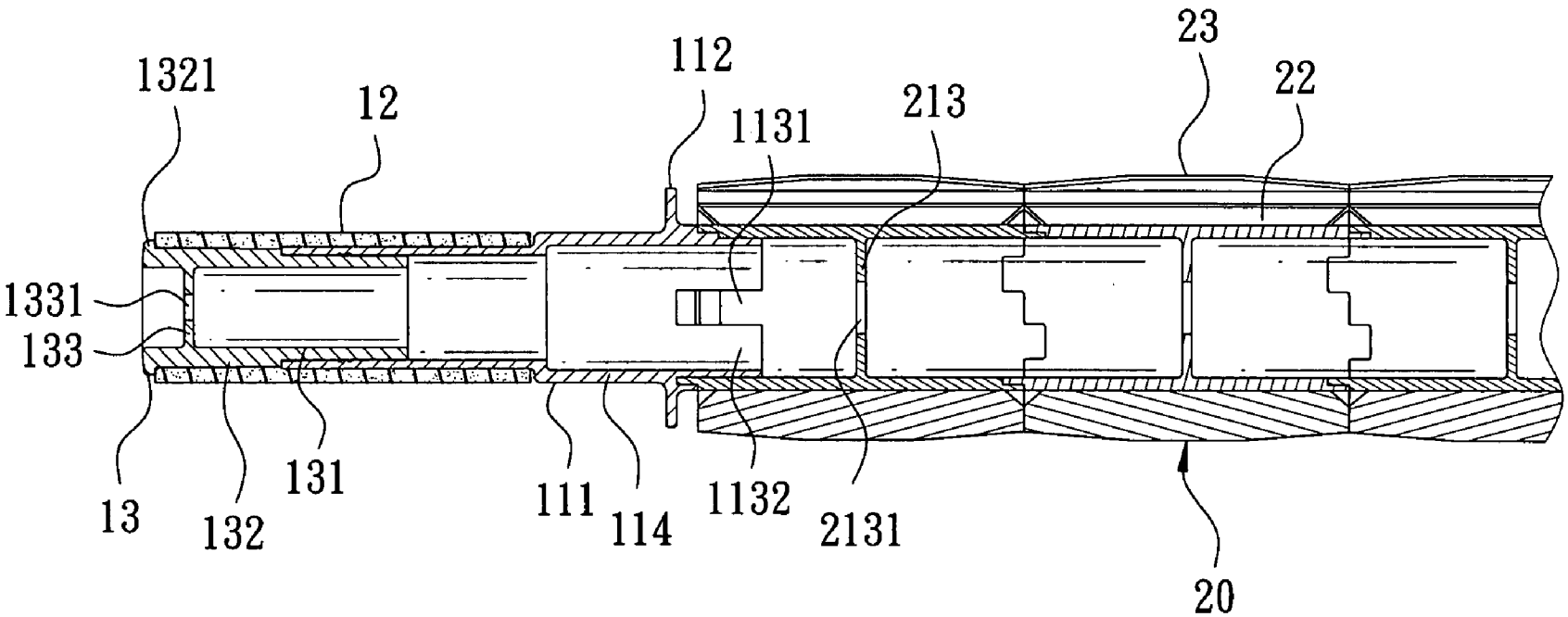
FIG. 5 is a cross-sectional view of the axle tubes of the film packing applicator of the present invention.

Each handle 10 comprises a handle sleeve 11, a soft handle cover 12, and a locating tube 13. The handle sleeve 11 has a sleeve body 111, a protruding ring 112 extending from an outer wall of a middle section of the sleeve body 111, an engaging unit 113 next to a first side of the protruding ring 112, a braking ring 114 next to a second side of the protruding ring 112, and a plurality of spaced locating circular grooves 115 formed in the sleeve body 111. The engaging unit 113 comprises a plurality of engaging notches 1131 which are spaced from each other and formed at the outer wall of the sleeve body 111. A curved board 1132 is defined between every two of the engaging notches 1131. The curved board 1132 is provided with an engaging block 1133 at an outer side thereof. The engaging block 1133 extends from the protruding ring 112 axially. The braking ring 114 is formed with a plurality of stripes 1141 on an outer surface thereof. The stripes 1141 are spaced from each other and arranged axially. The soft handle cover 12 is fitted onto the sleeve body 111 and one side of the soft handle cover 12 is connected to the braking ring 114. The locating tube 13 is inserted into the sleeve body 111 and connected to the other side of the soft handle cover 12. Referring to FIG. 5, the locating tube 13 is composed of a first locating tube 131 and a second locating tube 132 which are connected to each other. The first locating tube 131 is formed with a raised ring 1311 on an outer wall thereof. The raised ring 1311 corresponds to the locating circular grooves 115 for engaging with each other. The second locating tube 132 has a first side corresponding to the first locating tube 131 and holding against the sleeve body 111 and a second side which is opposite the first locating tube 131 and formed with a stop ring 1321 radially extending from a rim of the second locating tube 132. The stop ring 1321 holds against the soft handle cover 12. The locating tube 13 is formed with a first circular ring 133 therein. The first circular ring 133 has a first through hole 1331 at a central portion thereof.

Figure 4:
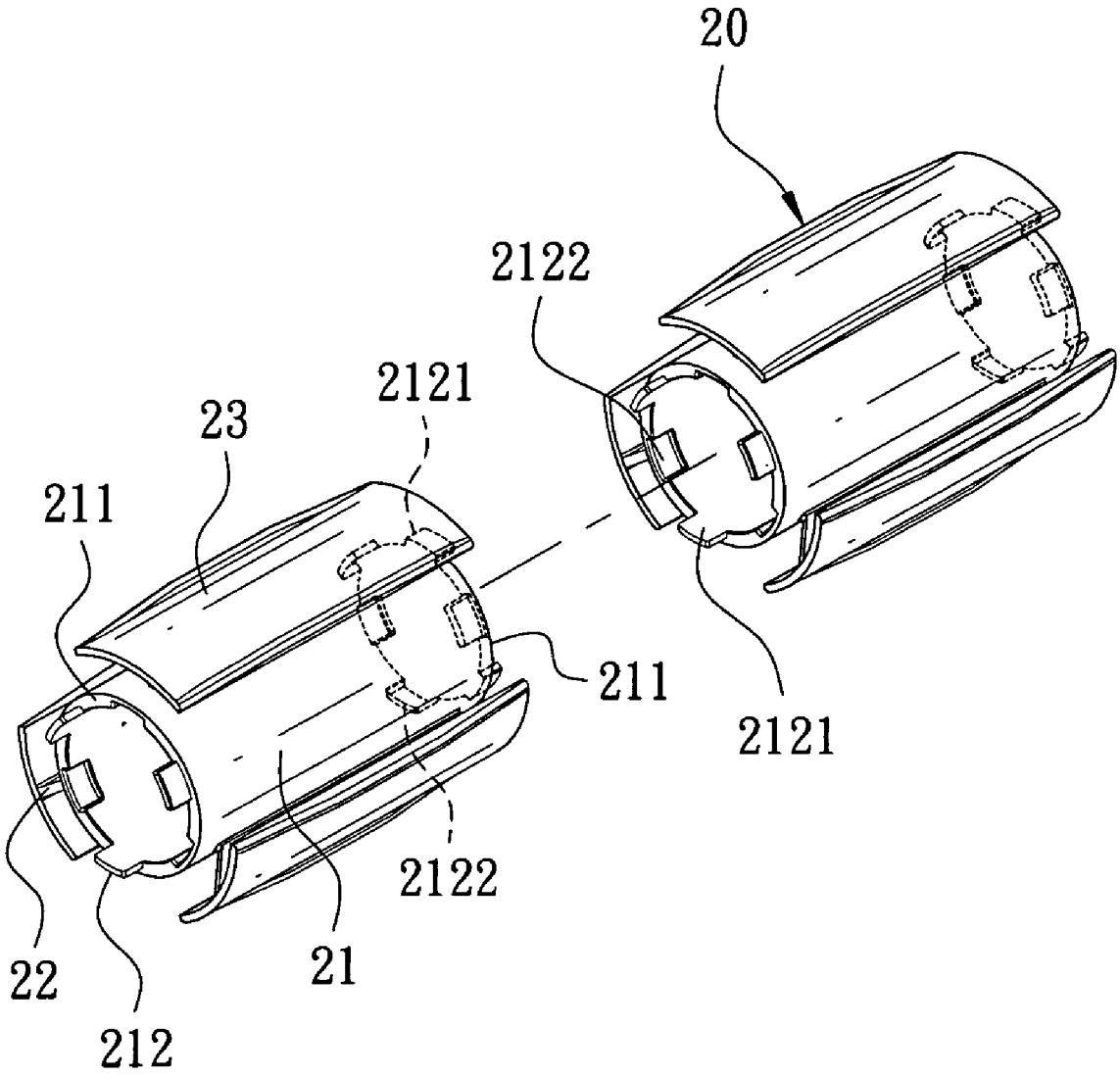
FIG. 4 is a perspective view of axle tubes of the film packing applicator of the present invention.

FIG. 4 is a perspective view of the film packing applicator of the present invention. The plurality of axle tubes 20 are connected in series between the two handle 10. Each axle tube 20 comprises a connecting tube 21. The connecting tube 21 has two open ends 211 at axial opposite sides thereof and a connecting unit 212 protruding from each of the open ends 211. The connecting unit 212 comprises a plurality of connecting blocks 2121 each axially extending from the open end 211 of the connecting tube 21. An inner wall of the connecting tube 21 is formed with a plurality of axial connecting troughs 2122 each disposed between every two of the connecting blocks 2121. The engaging notches 1131 and the engaging blocks 1133 engage with the connecting blocks 2121 and the connecting troughs 2122, respectively. The axle tubes 20 are connected together with the connecting blocks 2121 and the connecting troughs 2122. The connecting tube 21 is formed with a second circular ring 213 therein. The second circular ring 213 has a second through hole 2131 at a central portion thereof. The connecting tube 21 is provided with a plurality of spaced supporting ribs 22 on an outer wall thereof. Each of the supporting ribs 22 is provided with a tightening sheet 23 corresponding in shape to the outer wall of the connecting tube 21.

Figure 6:
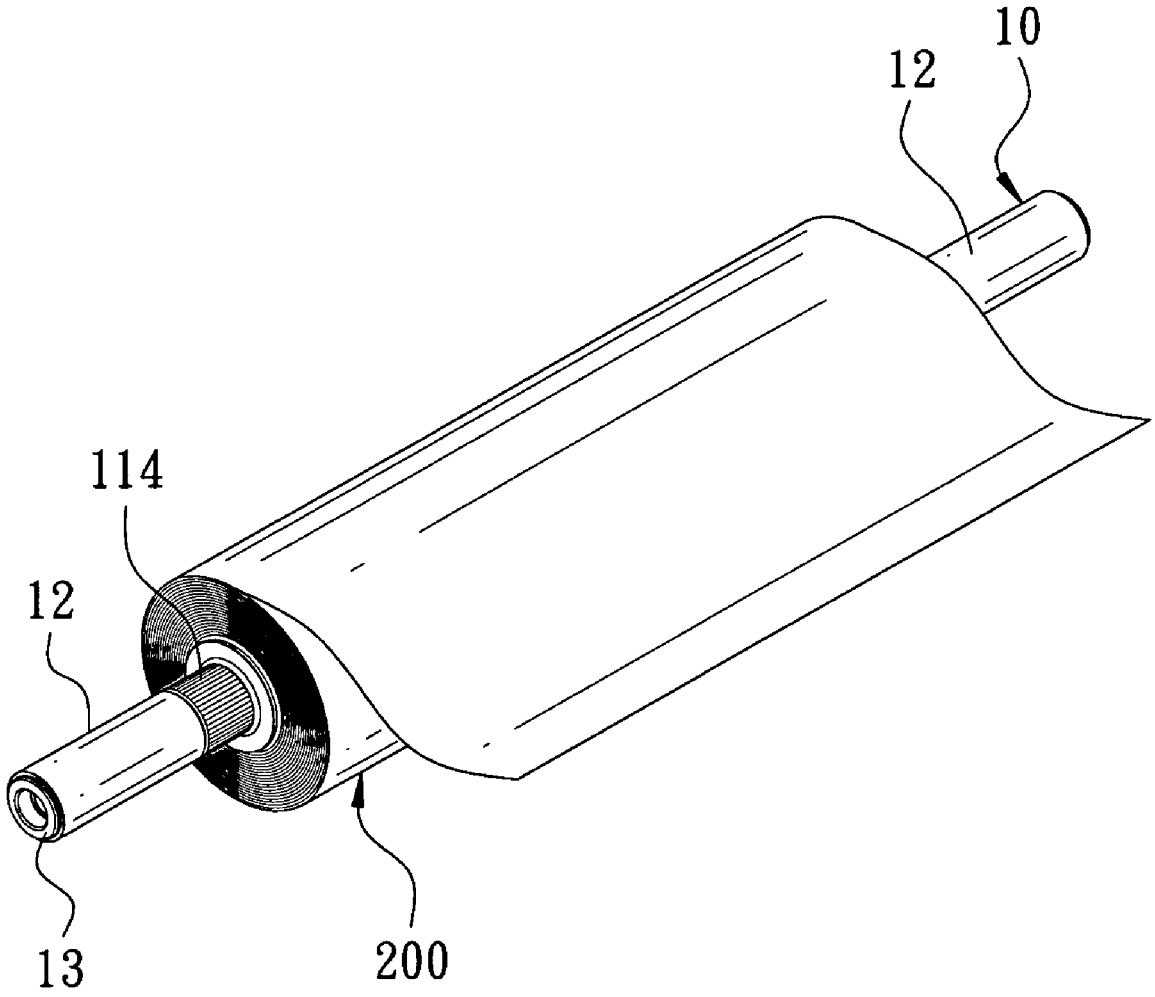
FIG. 6 is a perspective view of the film packing applicator of the present invention in use.

FIG. 6 is a schematic view showing the film packing applicator of the present invention in use. A roll of film 200 is inserted on the axle tubes 20, with the tighten sheet 23 to prop outward. The number of the axle tubes 20 is adjustable depending on the width of the film 200 for a user to operate the film packing applicator smoothly by holding the handles 10. Thus, the user is able to control the film 200 at an accurate position. When in use, the user holds the soft handle cover 12 and pulls the film packing applicator toward one side to pack an article. When not in use, the user holds the soft handle cover 12 with his/her thumb pressing the braking ring 114 to stop the handle sleeve 11 as well as the axle tubes 20. The axle tubes 20 are coupled together by the connecting blocks 2121 and the connecting troughs 2122, providing a fast way to couple the axle tubes 20. The handle sleeves 11 of the two handles 10 and the axle tubes 20 may be provided with a thick thread (not shown in the drawings) inserting through the first through hole 1331 and the second through hole 2131 for enhancing the entire strength of the handle sleeves 11 and the axle tubes 20.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A multi-section assembled film packing applicator, comprising:

at least two handles each comprising a handle sleeve and an engaging unit at one end of the handle sleeve;

a plurality of axle tubes connected in series between the two handles;

each of the axle tubes having two axial opposite ends, and each of the two axial opposite ends being provided with a connecting unit;

the connecting unit engaging with the engaging unit;

the axle tubes being connected with respective connecting units;

the engaging unit comprises a plurality of engaging notches which are spaced from each other and formed at one side of the sleeve body;

a curved board being defined between every two of the engaging notches;

the curved board being provided with an engaging block at an outer side;

each of the axle tubes comprising a connecting tube, the connecting tube having two open ends at axial opposite sides thereof and the connecting unit protruding from each of the open ends;

the connecting unit comprising a plurality of connecting blocks each axially extending from the open end of the connecting tube;

an inner wall of the connecting tube being formed with a plurality of axial connecting troughs each disposed between every two of the connecting blocks;

the engaging notches and the engaging blocks engaging with the connecting blocks and the connecting troughs, respectively; and the axle tubes being connected together with the connecting blocks and the connecting troughs.

2. The multi-section assembled film packing applicator as claimed in claim 1, wherein each of the handles comprises the handle sleeve, a soft handle cover, and a locating tube, the handle sleeve comprising a braking ring extending from an outer wall of a middle section of the sleeve body, the soft handle cover being fitted onto the handle sleeve and one side of the soft handle cover being connected to the braking ring, the locating tube being inserted into the handle sleeve and connected to another side of the soft handle cover.

3. The multi-section assembled film packing applicator as claimed in claim 2, wherein the braking ring is formed with a plurality of stripes on an outer surface thereof, the stripes being spaced from each other and arranged axially.

4. The multi-section assembled film packing applicator as claimed in claim 2, wherein the handle sleeve is formed with a plurality of spaced locating circular grooves therein, the locating tube being formed with a raised ring on an outer wall thereof, the raised ring corresponding to the locating circular grooves for engaging with each other, the locating tube being formed with a first circular ring therein, the first circular ring having a first through hole at a central portion thereof.

5. The multi-section assembled film packing applicator as claimed in claim 1, wherein the connecting tube is provided with a plurality of spaced supporting ribs on an outer wall thereof, each of the supporting ribs being provided with a tightening sheet corresponding in shape to the outer wall of the connecting tube, the connecting tube being formed with a second circular ring therein, the second circular ring having a second through hole at a central portion thereof.

* * * * *